United States Patent [19]

Lavertu et al.

[11] 4,065,529

[45] Dec. 27, 1977

[54] PROCESS FOR SPHEROIDIZATION OF RDX CRYSTALS

[75] Inventors: Roger R. Lavertu, Ste-Foy; Antonin Godbout, Charlesbourg, both of Canada

[73] Assignee: The United States of America as represented by the Secretary of the Army, Washington, D.C.

[21] Appl. No.: 646,838

[22] Filed: Jan. 5, 1976

[30] Foreign Application Priority Data

Jan. 13, 1975 Canada ..... 217770

[51] Int. Cl.[2] ..... C06B 21/00

[52] U.S. Cl. ..... 264/3 E; 264/3 E; 149/19.9; 149/92

[58] Field of Search ..... 264/3 E, 3 C, 3 D; 149/92, 19.9

[56] References Cited

U.S. PATENT DOCUMENTS

| | | | |
|---|---|---|---|
| 3,239,502 | 3/1966 | Lee et al. | 149/92 X |
| 3,351,585 | 11/1967 | Lee et al. | 149/92 X |
| 3,679,782 | 7/1972 | Andrew et al. | 264/3 E |
| 3,754,061 | 8/1973 | Forrest et al. | 264/3 D |

*Primary Examiner*—Edward A. Miller

*Attorney, Agent, or Firm*—Nathan Edelberg; Robert P. Gibson; Robert W. Church

[57] ABSTRACT

A technique for the spheroidization of angular RDX crystals. The technique consists of agitating such angular RDX crystals in a cyclohexanone medium saturated with RDX, during which time the temperature is raised to and then maintained at a predetermined level. When the desired degree of spheroidization obtained by partial dissolution and erosion is reached, the suspension is discharged to the centrifuge and washed. The process is carried out entirely in liquid media, which minimizes explosion hazards. It gives a high degree of spheroidization when crystals larger than about 70 microns are used. The use of such spheroidized RDX crystals increases the mix fluidity of composite explosives, thereby permitting the production of explosives having very high solid loadings in liquid binder or molten form.

8 Claims, 13 Drawing Figures

PROCESS FOR SPHEROIDIZATION OF RDX CRYSTALS

Figure 1A:
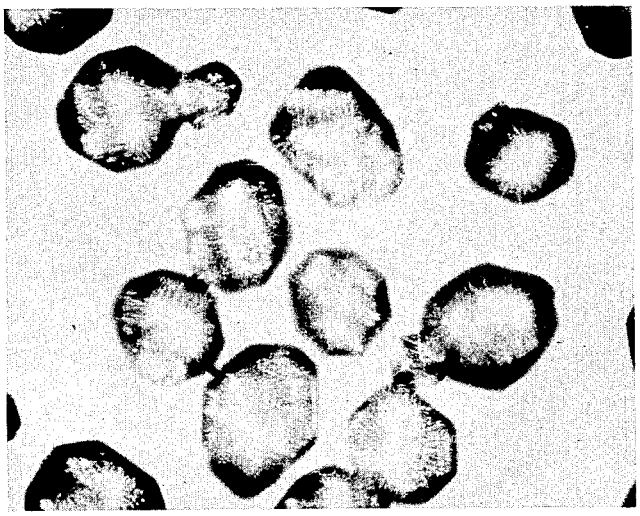

This invention relates to a method for the spheroidization of crystals of explosives, thereby increasing the fluidity of explosive mixes and augmenting the maximum energizer content of different types of explosives such as plastic bounded explosives. The method generally appears to be most effective in treating military or industrial explosives having a diameter of at least about 70 microns, and having orthorhombic or irregular angular shape. The technique consists of agitating such angular RDX crystals in a cyclohexanone medium saturated with RDX, during which time the temperature is raised to and then maintained at a predetermined level. When the desired degree of spheroidization obtained by partial dissolution and erosion is reached, the suspension is discharged to the centrifuge and washed.

In mid 1968 research was initiated at DREV on a new family of castable composite explosives. These include a crystalline explosive, RDX, dispersed in an elastomeric binder, hydroxyl-terminated polybutadiene, with a small percentage of diisocyanate as the curing agent. Some of them contain one or more additional ingredients, notably aluminum and ammonium perchlorate. The inert binder does not contribute to the explosive output, thus its concentration is usually kept to the minimum necessary to achieve the required fluidity in mixing and loading.

As it is well known in the field of solid propellants, the required concentration of binder can be reduced by promoting better packing of the solid ingredients. Better packing reduces the net free volume between particles so that less binder is needed to fill the voids. Commercial RDX particles consist of orthorhombic crystals, often with broken corners or edges. Better packing can be achieved if the corners and edges are rounded off. Moreover, the surface area per unit mass is reduced, which leads to lower mix viscosities.

In one aspect the present method developed for spheroidizing RDX crystals on a small scale consists of agitating RDX crystals in a saturated RDX-cyclohexanone solution for several hours, during which the temperature is raised over a certain initial period of time. The spheroidization is monitored by microscopic examination of crystals removed at intervals during the process. When spheroidization is sufficiently advanced, the suspension is filtered and washed.

The present invention therefore provides a method for the production of spheroids of RDX from angular crystals, comprising the steps of agitating angular crystals of RDX having a particle size of at least 70 microns in a cyclohexanone medium saturated with RDX at an initial temperature, with heating of the solution, followed by separation of the crystals from the heated solution. In the heating step the temperature would preferably be increased by at least 5° C, most preferably 8° C.

In a further embodiment the present invention provides such a method for the production of spheroids of RDX from angular crystals, comprising: (a) adding crystals of RDX to a saturated solution of RDX in cyclohexanone, at an initial temperature; (b) agitating said mixture of crystals and solution to erode said crystals, and (c) raising the temperature of said solution to increase the dissolution of the crystals; and (d) separating the crystals from the hot solution. Preferably step (d) comprises filtering said spheroidal crystals and washing said filtered crystals with alcohol. The temperature should preferably be increased to a sufficient extent to obtain up to about 15% by weight of RDX dissolved in said cyclohexanone.

The initial temperature should preferably be between 15° C and 25° C. More preferably the initial temperature is about 20° C and the elevated temperature is between 25° and 50° C.

The present invention provides spheroids of RDX having an average cross-section larger than about 74 microns.

The following is a brief description of the drawings, which show various RDX crystals, under varying conditions, each illustration being, in the attached drawings, shown with a magnification factor of 40:

FIG. 1*a* shows commercial RDX crystals as received.

Figure 1B:
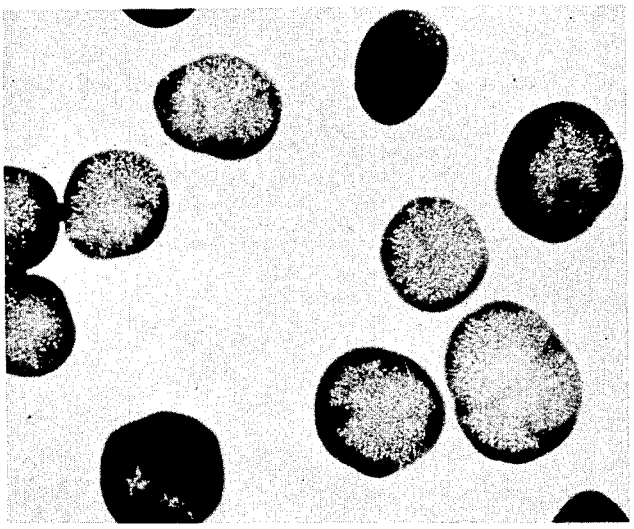

FIG. 1*b* shows the crystals of FIG. 1*a* 5 hours after spheroidization in a 1-gallon cylindrical reactor, as will be described below.

Figure 2A:
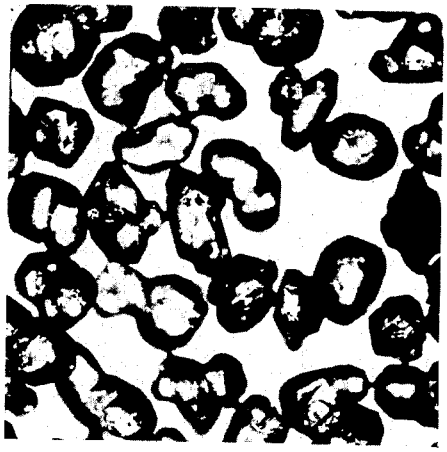
Figure 2B:
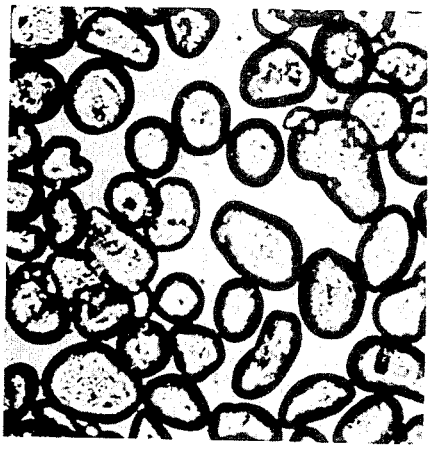
Figure 2C:
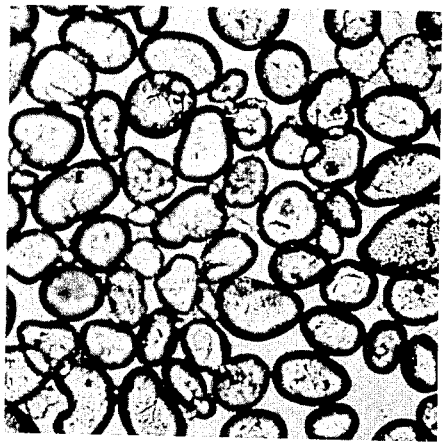
Figure 2D:
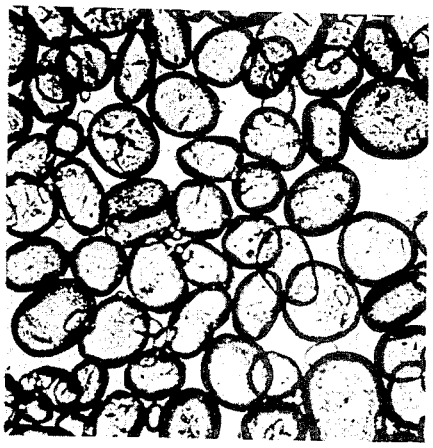

FIGS. 2*a*, 2*b*, 2*c* and 2*d* show the change in shape of RDX crystals at different times of mixing in the 1-gallon reactor; specifically, FIG. 2*a* shows the commercial RDX crystals (149 – 210 μm), FIG. 2*b* shows the crystals of FIG. 2*a* after 90 minutes of processing, FIG. 2*c* shows the crystals after 130 minutes (erosion), and FIG. 2*d* shows the crystals after 250 minutes (erosion).

Figure 3A:
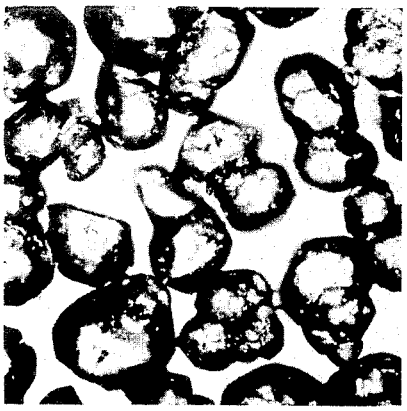
Figure 3B:
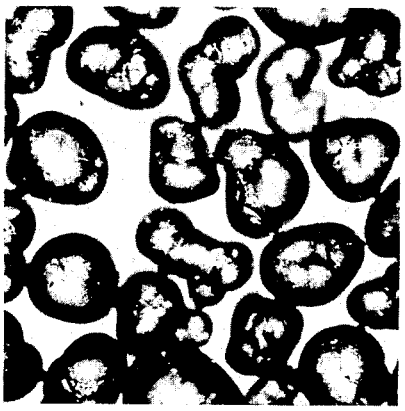
Figure 3C:
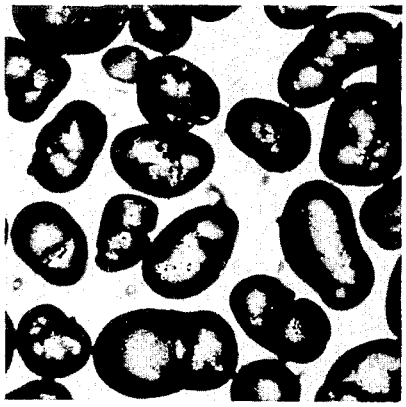
Figure 3D:
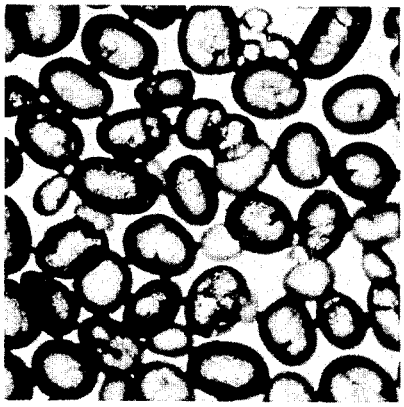

FIGS. 3*a*, 3*b*, 3*c* and 3*d* show the size and shape of crystals obtained after 6 hours of agitation with 2.5 inch turbine operating at different rotational speeds; specifically, FIG. 3*a* shows the commercial RDX crystals (210 – 297 μm), FIG. 3*b* shows the crystals after having been rotated at 400 revolutions per minute, FIG. 3*c* shows the crystals after the same have been rotated at 800 revolutions per minute, and FIG. 3*d* shows the crystals after having been rotated at 1200 revolutions per minute.

Figure 4:
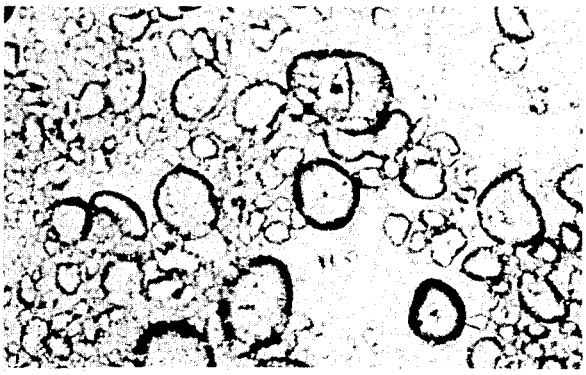

FIG. 4 shows the RDX crystals broken by a high rate of stirring.

Figure 5A:
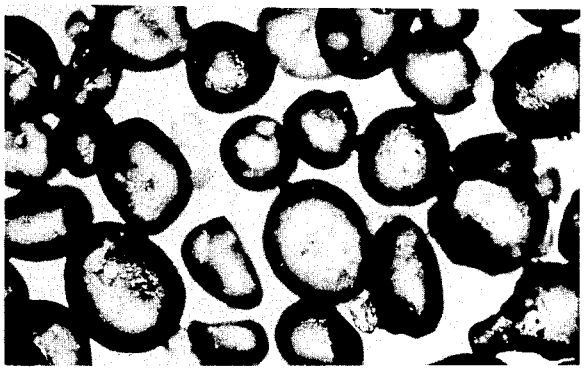
Figure 5B:
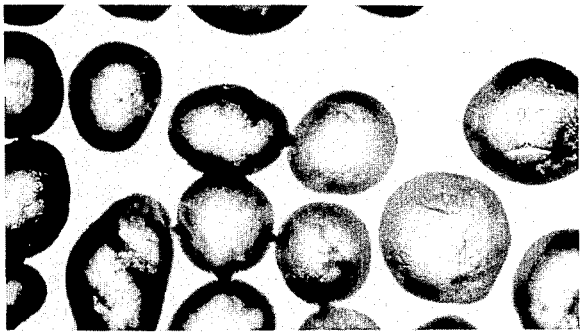

FIGS. 5*a* and 5*b* show the spheroidal crystals produced on pilot plant scale; specifically, FIG. 5*a* shows the crystals after 5 hours of processing (initial charge: 1.25 kg), and FIG. 5*b* shows the crystals after 3 hours of processing (initial charge: 6 kg).

The following examples show typical parameters for carrying out this process.

PROCEDURE

A 5-gal cylindrical jacketed reactor with four equally spaced baffles is used for spheroidization. It is equipped with a flush-mounted dumping valve located at the center of the round bottom. The agitation is obtained by a 3-in diameter duplex head dispersator, produced by Premier Mill Corporation, New York.

The filtering system consists of a 12-in basket centrifuge. The suspension is discharged through the reactor's dump valve, then via a pipe to the basket which spins at 1200 r/min.

The reactor is first loaded with 20 liters of a saturated solution of RDX in cyclohexanone at 20° C. The 6 kg of RDX crystals are added and the agitator started. The temperature of the suspension is then raised to 48° C and agitation is maintained constant for several hours. This results in a partial dissolution of added RDX crystals, usually about 15%. When spheroidization is sufficiently advanced, after about 3 hours of mixing, the suspension is passed through the centrifuge filter and the crystals washed with commercial grade ethanol. Finally, the fine particles are removed by wet-sieving through a 200-mesh (74 μm) screen.

MATERIALS AND EQUIPMENT

Cyclotrimethylenetrinitramine (RDX) type B, Classes A and C (Canadian Industries Limited).
Cyclohexanone, technical grade.
Ethanol, commercial grade.
Agitators: Straight-bladed turbine (SBT). Pitched-bladed or axial flow turbine (AFT), (Chemineer Inc., Ohio, U.S.A.). Simplex and Duplex head dispersators (Premier Mill Corp., New York).
Reactors: Two 1-gal stainless steel jacketed reactors (DREV design).

APPARATUS

The basic apparatus consists of a wet-sieving system for fractionating the as-received RDX, two types of temperature-controlled tanks which employ various models of agitators, and a vacuum filtration system.

WET-SIEVING SYSTEM

The RDX crystal size fractions used in this study were obtained by wet-sieving the RDX, either Class A or Class C, as defined in Military Specifications RDX MIL-R-398C. A variety of two-sieve arrangements mounted on an 18-in Sweco Vibro-Energy Separator were used. Table I gives the details of the sieve arrangements and the ranges of crystal size obtained. The average particle size of crystals was taken as the value for 50% by weight from the distribution curve obtained for each fraction, using an 8-in Tyler sieve set and the sieving procedure described in Military Specification RDX MIL-R-398C.

TABLE I

GRANULATIONS OF RDX CRYSTALS OBTAINED BY SIEVING

| Original RDX | Sieve Combination (mesh-Tyler) | Crystal Size Range (μm) | Average Particle size (μm) |
|---|---|---|---|
| Class A | −200 + 325 | 44–74 | 60 |
| Class A | −100 + 200 | 74–149 | 120 |
| Class A | − 65 + 100 | 149–210 | 170 |
| Class A | − 48 + 65 | 210–297 | 230 |
| Class C | − 28 + 48 | 297–595 | 380 |

REACTOR SYSTEMS

Laboratory scale studies were carried out using two 1-gal jacketed pots, each 8-in deep, but of different internal design. The first was cylindrical (6-in dia) with four equally spaced baffles 9/16 in wide. The other had a four-leaf clover cross-section with a major diameter of 7.5 in and a minor diameter of 6 in. The temperature in the jackets was controlled to ±0.03° C by a water bath circulator. No significant difference in results was seen between the two shapes of pots.

Two types of turbines and of dispersators were used as agitators. Straight-bladed turbines (SBT) with blades perpendicular to the center line give radial-flow patterns, and pitched-bladed turbines (so-called axial-flow turbines (AFT) with blades set at 45° to the center horizontal line give a combination of radial and axial-flow patterns. The dispersators consisted of a slotted cylindrical barrel or a slotted conical barrel both with internal baffles. Fluid enters at the bottom of the simplex dispersator and at both top and bottom of the duplex dispersator, and is ejected centrifugally from the side slots. A shearing action is applied to the crystal as the ejected jets and the surrounding fluid interact.

With the straight-bladed turbine (SBT) and the axial-flow turbine (AFT), severe vortices formed at high rotational speeds. Furthermore, a critical speed was reached with the SBT at which an air pocket formed around the blade assembly, which resulted in a poor circulation of the suspension; this speed was lower than that at which crystal breakup occurred. On the other hand, these phenomena were not encountered with the simplex and duplex dispersators, and the stirrer speed could be increased to the crystal breakup point. Moreover, the duplex dispersator permits a better circulation of the suspension since the liquid is 'pumped' both from the top and bottom of the reactor and is discharged at high speed horizontally towards the walls.

PROCEDURE

At laboratory scale, the reactor is first loaded with 2000 ml of a saturated solution of RDX in cyclohexanone at 20° C. Then 125 g of RDX crystals are added and the agitator started. The temperature of the suspension is raised while agitation is maintained constant for several hours, which results in a partial dissolution of the RDX crystals (usually of the order of 15–20%). To monitor the process, samples of crystals are taken at intervals for examination under a microscope. When spheroidization is sufficiently advanced, the suspension is quickly passed through a vacuum filter and the RDX crystals thoroughly washed with ethanol.

CHANGE OF PARTICLE SIZE DURING SPHEROIDIZATION

In one series of experiments, the change in the average particle during spheroidization was studied. Following the procedure above, RDX crystals between 297 and 595 μm with an average particle size of 380 μm were agitated for 5 hours in the baffled cylindrical reactor using the duplex head dispersator rotating at 3100 r/min. The temperature of the suspension was raised linearly from 22° to 36° C during the initial half-hour period. After filtering and washing the crystals, it was noted that 12% of the initial 125-g load of RDX had dissolved. In addition, some fine crystals which appeared to be fragments of larger broken ones were produced by the violent agitation. After removing the fines by sieving, the overall yield was 80%, with an average particle size of 300 μm and with 90% of the spheroidized crystals larger than 210 μm. FIG. 1 shows the crystals before and after the process. It is clear that the sharp edges of the original crystals have completely disappeared.

TIME OF AGITATION

The influence of the duration of agitation on the degree of spheroidization was studied by microscopic examination of samples of crystals taken during the experiments. In one typical run, RDX crystals with an average particle size of 170 μm were agitated in a saturated solution contained in the cylindrical baffled tank equipped with a 2.5-in diameter axial flow turbine rotating at 1200 r/min. During agitation, the temperature of the suspension was gradually raised to attain, after 30 minutes, a dissolution of 20% of the excess crystals. Samples taken after 90, 130 and 250 min of agitation are shown in FIG. 2. It is seen that after 90 min (FIG. 2-*b*) the spheroidization of the crystals was well advanced, owing to both partial dissolution and erosion effects. As the time of agitation was further increased, an improvement in the quality of spheroidization was obtained (FIG. 2-*c* and *d*). After the initial 30 min, however, only the erosion effect was acting on the crystals, the temperature being kept constant. Thus, the samples taken at 130 and at 250 min indicate that spheroidization can proceed by erosion alone.

EFFECT OF ROTATIONAL SPEED OF STIRRERS

Since erosion plays a significant role in the process of spheroidization, it was necessary to study the effect of the rotational speed of the stirrers on the degree of spheroidization. A series of experiments was carried out with the following equipment and conditions:

Baffled cylindrical reactor,
2.5-in axial flow turbine stirrer,
Rotational speeds: 400, 800, 1200 r/min,
Duration of each run: 6 hours
RDX crystals, 210 to 297 μm (average 230 μm),
20% dissolution of crystals in suspension by raising the temperature in the reactor.

At 400 and 800 r/min, the crystals lost their sharp edges (FIGS. 3-*b* and 3-*c*) but retained a variety of geometrical forms similar to those of the untreated RDX. At 1200 r/min, however, spheroidal crystals were obtained but, owing to the lengthy processing, their average particle size was considerably reduced.

Because the quality of spheroidization for a given period of processing is improved by increasing the speed of the agitator, it seemed important to process at the highest possible speed. Experiments indicated however that beyond a certain speed fragment breakup occurs (FIG. 4), even for short periods of processing. Table II, a summary of the experimental conditions, gives the peripheral speeds at which crystal breakup occurred. These data indicate that the minimum speed at which breakup occurs depends upon the particle size of the RDX crystals, i.e. the larger the crystal, the lower the minimum peripheral speed causing breaking of the particles. The controlling factor is possibly the momentum imparted to the crystals. For crystals having an average particle size of 120 μm, the critical peripheral speed is 2800 ft/min, whereas for crystals having an average particle size of 380 μm it is 1650 ft/min only. In all subsequent experiments, the best results were obtained by selecting a peripheral speed about 300 ft/min below the values quoted in Table II.

TABLE II

MINIMUM PERIPHERAL SPEEDS PRODUCING BROKEN CRYSTALS

| Crystal Sizes | | Agitator | | | |
|---|---|---|---|---|---|
| Range (μm) | Average (μm) | Type | Diameter (in) | r/min | Peripheral speed (ft/min) |
| 74–149 | 120 | Turb. (AFT) | 4.0 | 2600 | 2700 |
| 74–149 | 120 | Disp. (DM) | 1.37 | 8000 | 2900 |
| 149–210 | 170 | Turb. (AFT) | 4.0 | 2400 | 2500 |
| 149–210 | 170 | Disp. (DM) | 1.37 | 7200 | 2600 |
| 210–297 | 230 | Turb. (AFT) | 2.5 | 3600 | 2400 |
| 210–297 | 230 | Turb. (AFT) | 3.0 | 3100 | 2400 |
| 210–297 | 230 | Turb. (AFT) | 4.0 | 2200 | 2300 |
| 210–297 | 230 | Disp. (DM) | 1.37 | 7000 | 2500 |
| 297–595 | 380 | Turb. (AFT) | 4.0 | 1600 | 1700 |
| 297–595 | 380 | Disp. (DM) | 1.37 | 4400 | 1600 |

EFFECT OF RDX DISSOLUTION

A study was made of the degree of dependence of spheroidization upon the percentage of RDX crystals dissolved when raising the temperature of the solution. Experiments were performed, with crystals of 297 to 595 μm, using a 4-in axial-flow turbine rotating at 1200 r/min and varying the dissolution from 0 to 40%. For identical experimental conditions, the speed and quality of spheroidization improved as the percentage of the dissolution was increased from 0 to between 15 and 20. Beyond 20%, there was no further improvement; moreover the yield decreased owing to further reduction in the crystal size.

LIMITATION ON CRYSTAL SIZE

The technique described above gave good results for RDX crystals larger than 74 μm but did not for smaller crystals. In the case of the latter, there was a noticeable rounding off of sharp edges but the gross crystal shape remained orthorhombic so that true spheroidization was not achieved.

PILOT-PLANT-SCALE STUDIES

The main objective of the pilot-plant-scale studies was to test the applicability to a large-scale process of the laboratory spheroidization technique described in the first part of this report. A second objective was to optimize the process to produce as efficiently as possible the spheroidal crystals necessary for the development of composite explosives with very high solid contents.

METHOD

The technique used was the same as that used in the laboratory studies where the suspended crystals were submitted to partial dissolution and erosion by violent agitation.

MATERIALS AND EQUIPMENT

The chemical products and RDX crystals used in the pilot-plant experiments were the same as those used in the laboratory scale studies and are described in above. The equipment used was:

Agitator: 3-in. diameter Duplex head dispersator (Premier Mill Corp., New York).
Motor: ¾ hp electrical, with a mechanical variable speed drive 0–2200 r/min. (Greey Mixing Equipment)
Reactor: 5-gal stainless steel jacketed tank
Centrifuge Filter: Basket type, 12-in diameter (Tolhurst Centrifugals, Illinois).

APPARATUS

The apparatus consists of the wet-sieving systems described earlier for fractionating the as-received RDX, a temperature-controlled reactor employing a duplex head dispersator as agitator, and a basket type centrifuge filter.

REACTOR SYSTEM

As shown above, crystals treated in the 1-gal clover leaf reactor and in the 1-gal baffled cylindrical tank gave similar results. Since the latter design was simpler to fabricate it was selected for the pilot-plant studies. The 5-gal cylindrical jacketed reactor is 14-in inside diameter and 18-in deep with four equally spaced baffles (width 1.5 in). It is equipped with a flush-mounted dumping valve located at the center of the round bottom. On the basis of results obtained in small-scale studies a duplex model dispersator (3-in diameter) was selected as agitator. The principal dimensions and ratios of the two cylindrical reactors are summarized in Table III; the dimensional ratios are similar in each case.

TABLE III

SPECIFICATIONS OF CYLINDRICAL REACTOR SYSTEMS

| | Tank Diam. (in) 'T' | Tank Height (in) 'L' | Disp. Diam (in) 'D' | Baffle size (in) 'B' | L/T | T/D | T/B |
|---|---|---|---|---|---|---|---|
| Laboratory | 6 | 8 | 1 | 0.56 | 1.3 | 6 | 11 |
| Pilot Plant | 14 | 18 | 3 | 1.5 | 1.3 | 4.5 | 9 |

CENTRIFUGE FILTER

The filtering system consists of a basket centrifuge having a 12-in diameter. The suspension is discharged through the reactor's dump valve, then via a pipe to the basket which spins at 1200 r/min.

PROCEDURE

Initially, 20 l of a saturated solution of RDX in cyclohexanone at room temperature is loaded into the reactor, after which 6 kg of RDX is added. The speed of the dispersator is adjusted to about 300 ft/min below the minimum breakup speed for the crystals present. As noted earlier, the minimum breakup speed is dependent on the crystal size but independent of the type of stirrer (Table II). The temperature of the suspension is gradually raised by about 28° C during a 20-min period, which results in partial dissolution (usually 15%) of the added RDX crystals. Crystal samples removed at avarious intervals are examined under a microscope to monitor the process. When spheroidization is sufficiently advanced (about 3 hours of mixing), the suspension is passed through a basket centrifuge filter and the crystals washed with commercial grade ethanol. Finally, the fine particles are removed by wet sieving through a 200-mesh (74 μm) screen.

RESULTS

The aim of the pilot-plant trials was to test the applicability of the method developed on the laboratory-scale and then to optimize the process. Thus a concise set of results are given, which are closely related to these objectives.

SPHEROIDIZATION IN THE 5-GAL REACTOR

In a preliminary series of experiments, 1.25 kg of RDX crystals between 297 and 595 μm was added to 20 l of a saturated solution of RDX in cyclohexanone at 20° C. The dispersator was then run at 1650 r/min and the temperature raised by 7° C. Spheroidization was found to be sufficiently advanced (FIG. 5-*a*) after 5 hours. An examination of the smaller crystals (<74 μm) separated by wet-sieving showed that they could not be considered spheroidal in nature. The average yield of spheroidal particles greater than 74 μm was 65 to 70% of the initial load, the non-spheroidal particles (<74 μm) constituting about 5 to 10%.

In further experiments, an attempt was made to increase both the actual and percentage yields from a single run. The initial load of RDX was increased from 1.25 kg to 6 kg for 20 l of cyclohexanone saturated solution, and so the concentration of undissolved solids was 30%, compared to 6% in the first run. The temperature was raised by 28° C, to dissolve about 15% of the added crystals. Spheroidization was found to be sufficiently advanced after only 3 hours of agitation (FIG. 5-*b*). The shorter processing time was probably caused by more effective erosion, due to the higher solid content of the suspension. There was no change in the percentage yield or quality of the product, while the actual output per run was greatly increased.

CONSUMPTION OF MATERIALS

Although the net yield of spheroidized particles was in the range of 65 to 70%, the overall loss of RDX (and cyclohexanone) in the complete processing of composite explosives was negligible. Product RDX particles smaller than 74 μm were incorporated into the fine RDX crystal fraction of the bimodal distribution used in composite explosive formulations. The same use was made of the fine crystals which precipitate when the RDX-saturated cyclohexanone used in the process is cooled to room temperature. Except for the small quantity of cyclohexanone remaining in the RDX cake after centrifuging, the cyclohexanone was reused continuously. However, the 2 gal of ethanol used for washing the RDX cake was not recovered.

EFFECT OF SPHEROIDAL RDX ON THE PROCESSIBILITY OF CASTABLE COMPOSITE EXPLOSIVES

The effectiveness of spheroidization was verified experimentally for a castable composite explosive. Two formulations were prepared, each having the same percentage of RDX of a comparable particle size distribution, one containing orthorhombic crystals and the other a large fraction of spheroidized crystals. Table IV summarizes these formulations and gives the viscosity of each, as measured at the end of the mixing period.

TABLE IV

VISCOSITIES OF UNCURED COMPOSITE EXPLOSIVES MADE USING ORTHORHOMBIC AND SPHEROIDAL CRYSTALS

| Binder (HTPB) | Solids (RDX) | Shape | RDX Crystals Size (μm) | RDX Crystals Fraction (%) | Viscosity (cP) |
|---|---|---|---|---|---|
| 16 | 84 | Ort. | +210−297 | 70 | 1,800,000 |
| | | Ort. | −44 | 30 | |
| 16 | 84 | Sphe. | +210−297 | 70 | 800,000 |
| | | Ort. | −44 | 30 | |

It is apparent that replacing the coarse fraction of orthorhombic crystals by spheroidal ones of the same particle size reduces the viscosity by at least 50%. This reduction is very significant in studies of compositions with very high solid loading. In fact, by using a blend of fine RDX and spheroidal coarse crystals (30/70) and increasing the plasticizer level, a formulation containing 88% of RDX was mixed and cast at a viscosity of 600,000 cP.

CONCLUSIONS

A processing technique has been developed for the production of spheroidized RDX crystals at a rate of about 2 kg/h. The method could be scaled up to a higher production rate if required and is carried out entirely in liquid media, which minimizes explosion hazards. The method depends on both partial dissolution and erosion of the particles in an agitated saturated solution of RDX in cyclohexanone. It is limited to particles having an initial size greater than 70 μm.

Although the net yield of spheroidized particles is 65 to 70% in the examples above, the overall loss of ingredients in the production of composite explosives is very low, particularly when compared to methods of the prior art. The viscosities of high-solid-content composite explosives, were lowered appreciably by the use of the spheroidized crystals in place of unprocessed commercial crystals.

The present spheroidization method is simple and versatile.

The embodiments of the invention in which an exclusive property or privilege is claimed are defined as follows:

1. A method for the production of spheroids of cyclotrimethylenetrinitramine from angular crystals, comprising the steps of agitating angular crystals of cyclotrimethylenetrinitramine having a particle size of at least 70 microns in a cyclohexanone medium saturated with RDX at an initial temperature, with heating of the solution, followed by separation of the crystals from the heated solution.

2. A method as in claim 1 wherein the heating step increases the temperature by at least 5° C.

3. A method as in claim 1 wherein the temperature is increased to obtain between 5 to 20% by weight of added cyclotrimethylenetrinitramine dissolve in said cyclohexanone.

4. A method as in claim 1 for the production of spheroids of cyclotrimethylenetrinitramine from angular crystals, comprising:

a. adding crystals of cyclotrimethylenetrinitramine to a saturated solution of cyclotrimethylenetrinitramine in cyclohexanone, at an initial temperature,
b. agitating said mixture of crystals and solution to erode said crystals,
c. raising the temperature of said solution to increase the dissolution of the crystals, and
d. separating the crystals from the hot solution.

5. A method for making spheroids of cyclotrimethylenetrinitramine as in claim 4, wherein step (d) comprises filtering said spheroidal crystals and washing said filtered crystals with alcohol.

6. The method as defined in claim 5 wherein the temperature is increased to obtain up to about 15% by weight of cyclotrimethylenetrinitramine dissolved in said cyclohexanone.

7. The method of making spheroids of cyclotrimethylenetrinitramine as defined in claim 4 wherein said initial temperature is between about 15° C and 25° C.

8. The method as defined in claim 4 wherein the initial temperature is about 20° C and the elevated temperature is between 25° and 50° C.

* * * * *

UNITED STATES PATENT AND TRADEMARK OFFICE

CERTIFICATE OF CORRECTION

PATENT NO. : 4,065,529

DATED : December 27, 1977

INVENTOR(S) : Roger R. Lavertu, Ste-Foy; Antonin Godbout, Charlesbourg, both of Canada It is certified that error appears in the above—identified patent and that said Letters Patent is hereby corrected as shown below:

Title page, Item [73] should read as follows:

Assignee: -- Her Majesty the Queen in right of Canada, as represented by the Minister of National Defence, Ottawa, Canada --

Signed and Sealed this

*Twenty-eighth* Day of *May 1985*

[SEAL]

*Attest:*

DONALD J. QUIGG

*Attesting Officer* *Acting Commissioner of Patents and Trademarks*